US006168236B1

(12) United States Patent
Chen

(10) Patent No.: US 6,168,236 B1
(45) Date of Patent: Jan. 2, 2001

(54) EASY-TO-ASSEMBLE/RECYCLE ARMREST

(76) Inventor: Su-Jan Chen, P.O. Box 63-247, Taichung (TW)

( * ) Notice: Under 35 U.S.C. 154(b), the term of this patent shall be extended for 0 days.

(21) Appl. No.: 09/480,774

(22) Filed: Jan. 10, 2000

(51) Int. Cl.[7] ..... A47C 7/54
(52) U.S. Cl. ..... 297/411.2; 297/440.1
(58) Field of Search ..... 297/411.2, 440.1; 403/329; 248/118

(56) References Cited

U.S. PATENT DOCUMENTS 5,395,161 * 3/1995 Spykerman et al. .
5,439,268 * 8/1995 Dozsa-Farkas .
5,667,277 * 9/1997 Van De Riet .

* cited by examiner

*Primary Examiner*—Milton Nelson, Jr.
(74) *Attorney, Agent, or Firm*—Alan Kamrath

(57) ABSTRACT

An armrest includes a lower cover with a number of retainer rings and an upper cover mounted on top of the lower cover. A number of metal nut fasteners are mounted in the retainer rings, respectively. Each nut fastener has a screw hole to allow the armrest to be mounted to a base by screws. A number of engaging plates are provided for securely engaging the upper cover with the lower cover. The metal nut fasteners can be easily removed by breaking the retainer rings.

16 Claims, 7 Drawing Sheets

EASY-TO-ASSEMBLE/RECYCLE ARMREST

BACKGROUND OF THE INVENTION

1. Field of the Invention

The present invention relates to an armrest that can be easily and quickly assembled and that is advantageous to recycle.

2. Description of the Related Art

A typical armrest is shown in FIG. 6 of the drawings, wherein an upper cover 1' is mounted to a lower cover 2' by screws 3'. The upper cover 1' includes a number of recesses 7' and the lower cover 2' includes a number of holed pegs 6' that are respectively received in the recesses 7' of the upper cover 1'. Such an armrest is used for a chair that allows adjustment in the armrest. Nevertheless, the assembly speed is low, as one has to locate the upper cover 1' right above the lower cover 2' for aligning screw holes 4' in the lower cover 2' with screw holes 5' in the upper cover 1' and then insert the screws 3' into the aligned screw holes 4' and 5', respectively.

FIG. 7 of the drawings illustrates another conventional armrest that includes a lower cover 10' with a number of holes 12' and an upper cover 20' with a number of nails 30' for engaging with the holes 12'. The nails 30' are integrally formed with the upper cover 20' by plastic molding injection. As a result, the nails 30' are apt to break if the holes 12' and the nails 30' are not precisely aligned with each other. Some manufacturers put metal holed pegs or nuts into the mold before forming the armrest such that the holed pegs or nuts are embedded in the armrest after injection molding. Yet, it is not advantageous to recycle.

SUMMARY OF THE INVENTION

It is a primary object of the present invention to provide an improved armrest that can be easily and quickly assembled and recycled.

An armrest in accordance with the present invention comprises:

a lower cover including a plurality of retainer rings;

an upper cover mounted on top of the lower cover;

a plurality of nut fasteners mounted in the retainer rings, respectively, each said nut fastener having a screw hole; and means for securely engaging the upper cover with the lower cover.

The lower cover includes a plurality of lower fixing plates and the upper cover includes a plurality of upper fixing plates. The engaging means includes a plurality of engaging members for securely engaging the upper fixing plates with the lower fixing plates.

Each engaging member is a substantially S-shape plate and includes a first outer plate section, a second outer plate section, and an intermediate plate section between the first outer plate section and the second outer plate section. The first outer plate section and intermediate plate section together define a first compartment for securely holding an associated upper fixing plate of the upper cover. The second outer plate section and the intermediate plate section together define a second compartment for securely holding an associated lower fixing plate of the lower cover.

Each upper fixing plate of the upper cover includes a vertical recess for receiving the first outer plate section of an associated said engaging member. The first outer plate section of each engaging member includes two notches defined in two opposite sides thereof, the notches being engaged with two vertical side walls that define the vertical recess of the associated upper fixing plate.

Each lower fixing plate of the lower cover includes a vertical recess for receiving the second outer plate section of an associated engaging member. The second outer plate section of each engaging member includes two notches defined in two opposite sides thereof, the notches being engaged with two vertical side walls that define the vertical recess of the associated lower fixing plate.

Each retainer ring includes an inner ring therein, the inner ring including a through-hole. Each nut fastener includes an enlarged head and a stem that is mounted in the through-hole. Each retainer ring includes four vertical slits to thereby form two retainer ring sections in which each retainer ring section is defined between two adjacent slits. Each retainer ring includes a projection with an inclined outer surface for guiding an associated nut fastener into the associated retainer ring. Each inner ring further includes four stops projected outward from an outer periphery thereof, wherein a first and a second of the four stops together define a first compartment, and a third and a fourth of the stops together define a second compartment. Each nut fastener includes two claws extended outward from the enlarged head thereof, wherein a first of the two claws is engaged in the first compartment and a second of the two claws is engaged in the second compartment to thereby prevent rotation of the nut fastener in the retainer ring.

Other objects, advantages, and novel features of the invention will become more apparent from the following detailed description when taken in conjunction with the accompanying drawings.

DETAILED DESCRIPTION OF THE PREFERRED EMBODIMENT

Figure 1:
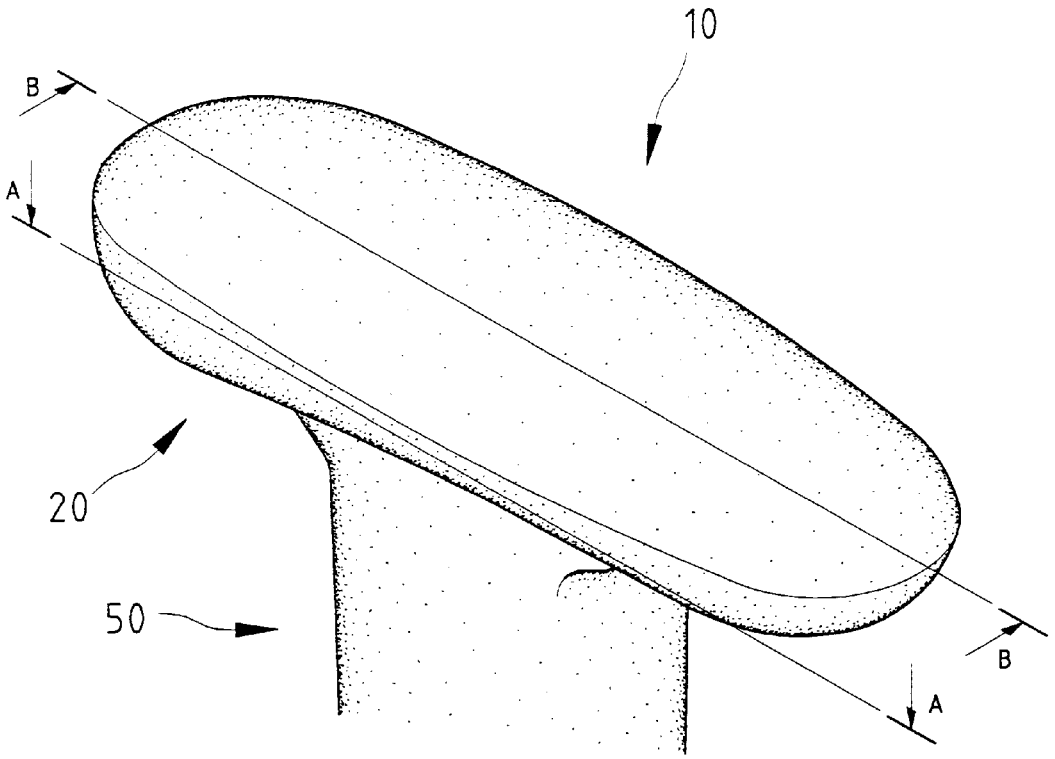
FIG. 1 is a perspective view of an armrest in accordance with the present invention.
Figure 2:
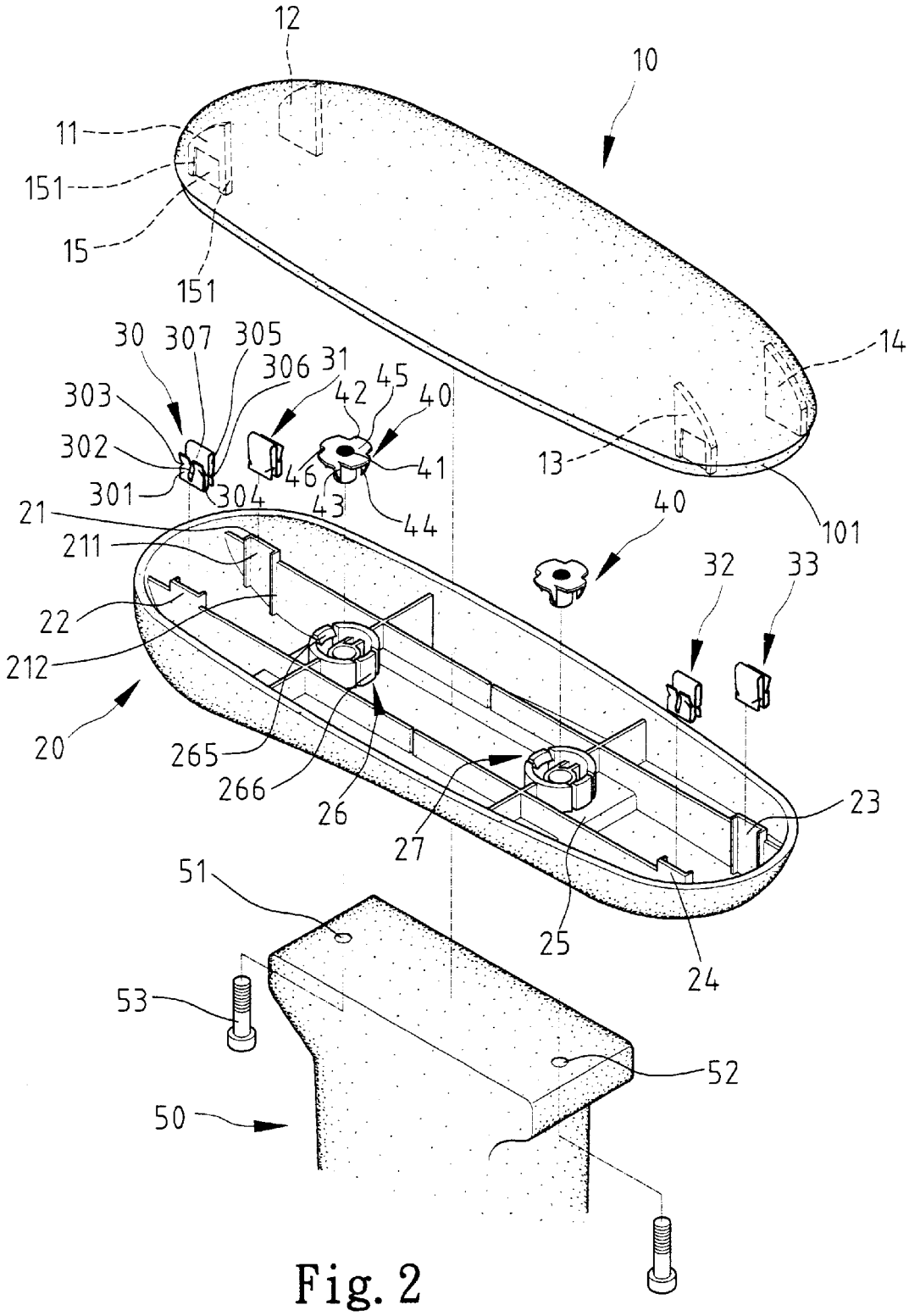
FIG. 2 is an exploded perspective view of the armrest in accordance with the present invention.
Figure 3:
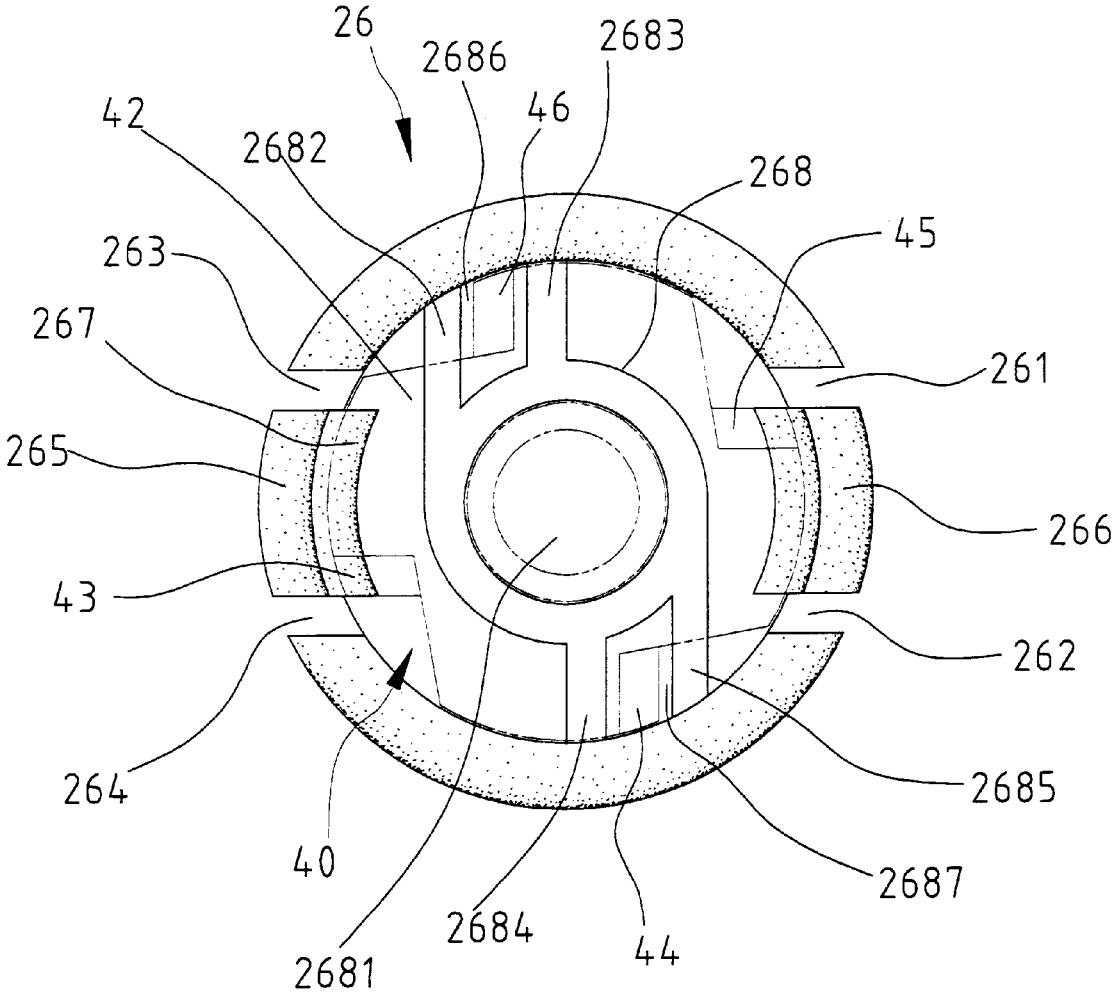
FIG. 3 is an enlarged top view of a retainer ring in accordance with the present invention.

Referring to FIGS. 1 and 2, an armrest in accordance with the present invention generally includes an upper cover 10 that is substantially oval and has a hollow interior defined by a skirt or annular flange 101 extended from a periphery of the upper cover 10. Each of four corner areas of the inner side of the upper cover 10 has an upper fixing plate 11, 12, 13, 14 with a vertical recess 15.

The armrest further includes a lower cover 20 that is also substantially oval and hollow. The lower cover 20 is sized and dimensioned to receive the annular flange 101 of the upper cover 10. Formed on each of four corner areas of a bottom 25 of the lower cover 20 is a lower fixing plate 21, 22, 23, 24 with a vertical recess 211. Formed on mediate portion of the bottom 25 of the lower cover 20 are two retainer rings 26, 27 each having four vertical slits 261, 262, 263, 264, thereby forming two retainer ring sections 265 and 266 with certain resiliency. Referring to FIGS. 2 through 5; the retainer ring section 265, 266 has a projection 267 on an inner wall thereof, the projection 267 having an inclined outer surface. Formed in a center of the annular retainer ring 26 is an inner ring 268 that has a through-hole 2681. Four stops, 2682, 2683, 2684, 2685 project outward from an outer periphery of the inner ring 268, wherein stop 2685 and stop 2684 are parallel to each other and define a compartment 2687 therebetween, and stop 2682 and stop 2683 are also parallel to each other and define a compartment 2686 therebetween, best shown in FIG. 3.

Four engaging means 30, 31, 32, 33 are provided and each of which is a substantially S-shape plate with a first outer plate section 301, a second outer plate section 305, and an intermediate plate section (not labeled) between the first outer plate section 301 and the second outer plate section 305. When the upper cover 10 is mounted on top of the lower cover 20, the first outer plate section 301 of each engaging means 30, 31, 32, 33 is inserted into the vertical recess 15 of an associated upper fixing plate 11, 12, 13, 14, and the second outer plate section 305 of each engaging means 30, 31, 32, 33 is inserted into the vertical recess 211 of an associated lower fixing plate 21, 22, 23, 24. The first outer plate section 301 of each engaging means 30, 31, 32, 33 has certain resiliency by, e.g., forming a slit 302 in a mediate portion thereof. The first outer plate section 301 of each engaging means 30, 31, 32, 33 further includes two symmetrically disposed notches 303 and 304 formed on two lateral sides thereof. Each notch 303, 304 is engaged with a vertical side wall 151 (FIG. 2) defining the vertical recess 15 of the associated upper fixing plate 11, 12, 13, 14 when the upper cover 10 is mounted on top of the lower cover 20. Thus, removal of the engaging means 30, 31, 32, 33 from the recess 15 is prevented. The second outer plate section 305 of each engaging means 30, 31, 32, 33 further includes two symmetrically disposed notches 306 and 307 formed on two lateral sides thereof. Each notch 306, 307 is engaged with a vertical side wall 212 defining the vertical recess 211 of the associated lower fixing plate 21, 22, 23, 24 when the upper cover 10 is mounted on top of the lower cover 20. Thus, removal of the engaging means 30, 31, 32, 33 from the recess 212 (FIG. 2) is prevented. Further, it is noted that the first outer plate section 301 and the intermediate plate section of each engaging means 30, 31, 32, 33 together define a compartment for securely holding an associated upper fixing plate 11, 12, 13, 14, and the second outer plate section 305 and the intermediate plate section of each engaging means 30, 31, 32, 33 together define a compartment for securely holding an associated lower fixing plate 21, 22, 23, 24.

Two nut fasteners 40 are provided and each of which includes a screw hole 41. Each nut fastener 40 includes an enlarged head 42 and a stem (not labeled) with an outer diameter smaller than an inner diameter of the inner ring 268 of an associated retainer ring 26, 27. The enlarged head 42 of each nut fastener 40 includes four spaced positioning claws 43, 44, 45, 46 projected outward along a longitudinal direction of the stem. Each nut fastener 40 is mounted into the inner ring 268 of an associated retainer ring 26, 27 under the guidance of the inclined surface of each projection 267, wherein the retainer ring section 265, 266 is engaged with a top face of the enlarged head 42 of the associated nut fastener 40 by the projection 267. Thus, removal of the nut fastener 40 is prevented by the projections 267 of the retainer ring sections 265, 266. In addition, one of the positioning claws (e.g., claw 46) is inserted into the compartment 2686 of the retainer ring 26, 27, and another positioning claw 44 is inserted into the other compartment 2687 of the retainer ring 26, 27. Thus, rotation of the nut fastener 40 is prevented, best shown in FIG. 3.

The armrest is mounted to a base 50 that includes a top portion to be received in a groove 28 defined in an underside of the bottom of the lower cover 20. The top portion of the base 50 includes two through-holes 51 and 52 that are aligned with the through-holes 2681 of the inner rings 268. A bolt or screw 53 is extended through each through-hole 51, 52 of the base 50 and the screw hole 41 of an associated nut fastener 40 that is securely mounted in an associated retainer ring 26, 27.

Figure 4:
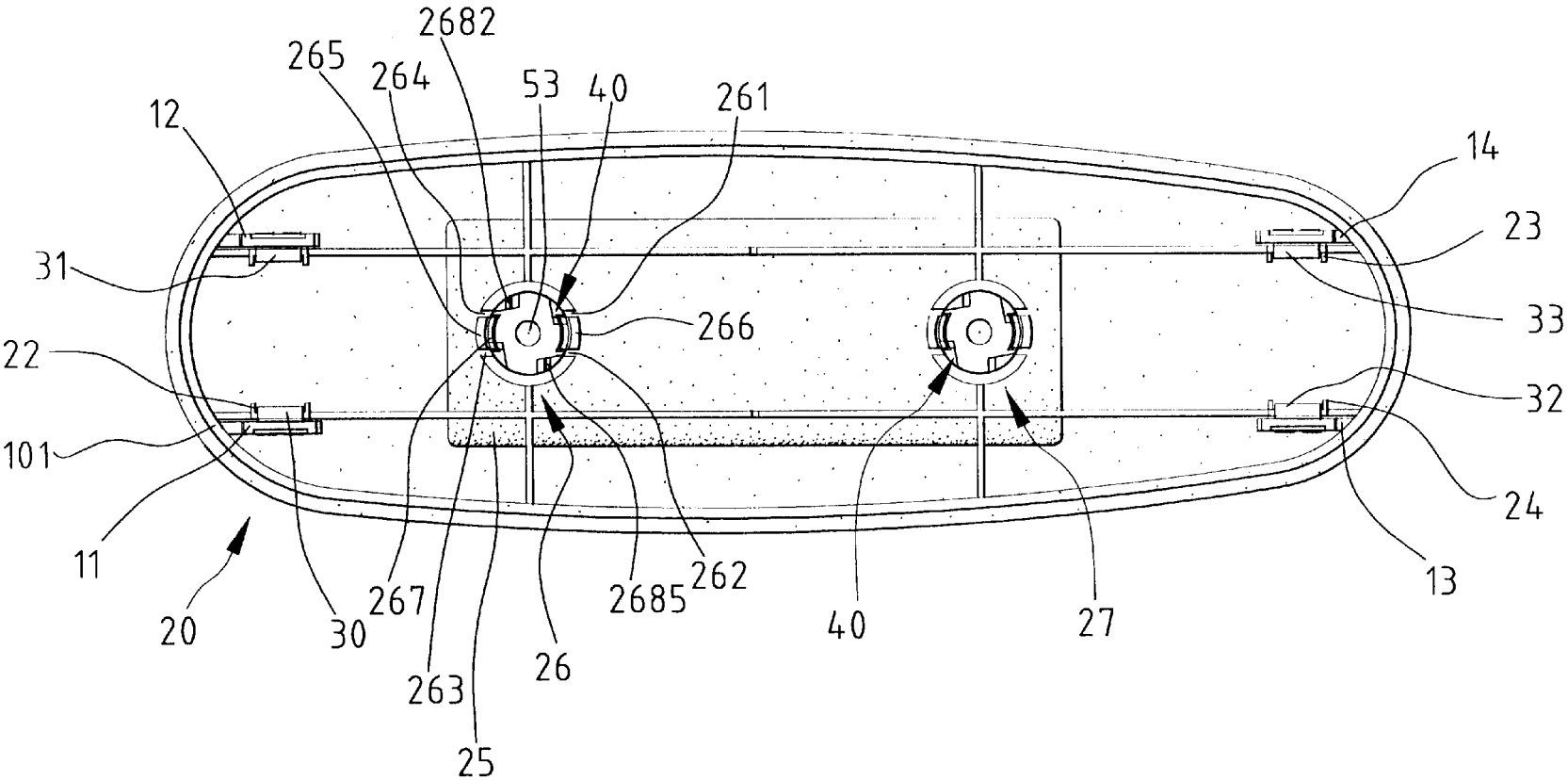
FIG. 4 is a sectional view taken along line A—A in FIG. 1.
Figure 5:
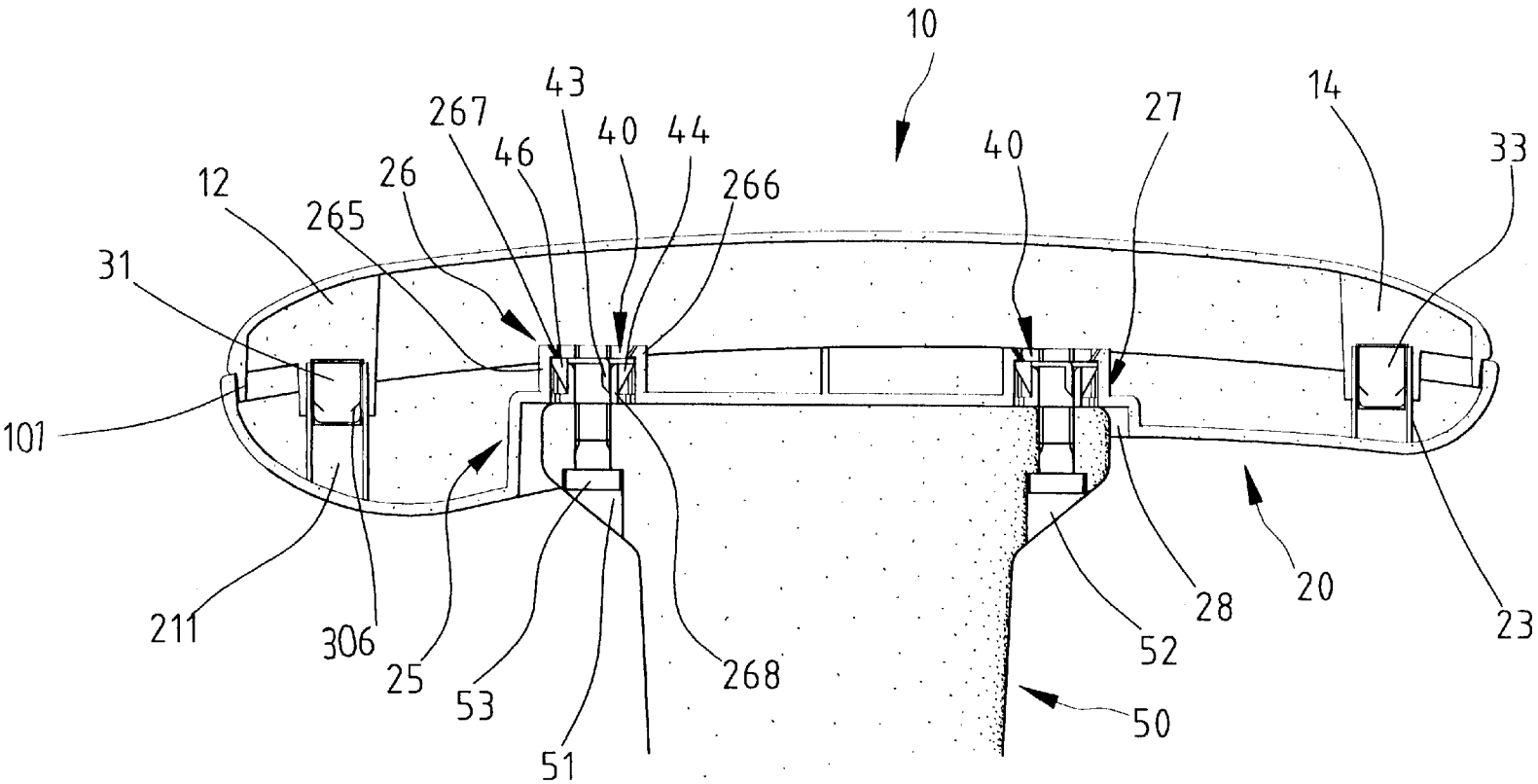
FIG. 5 is a sectional view taken along line B—B in FIG. 1.
Figure 6:
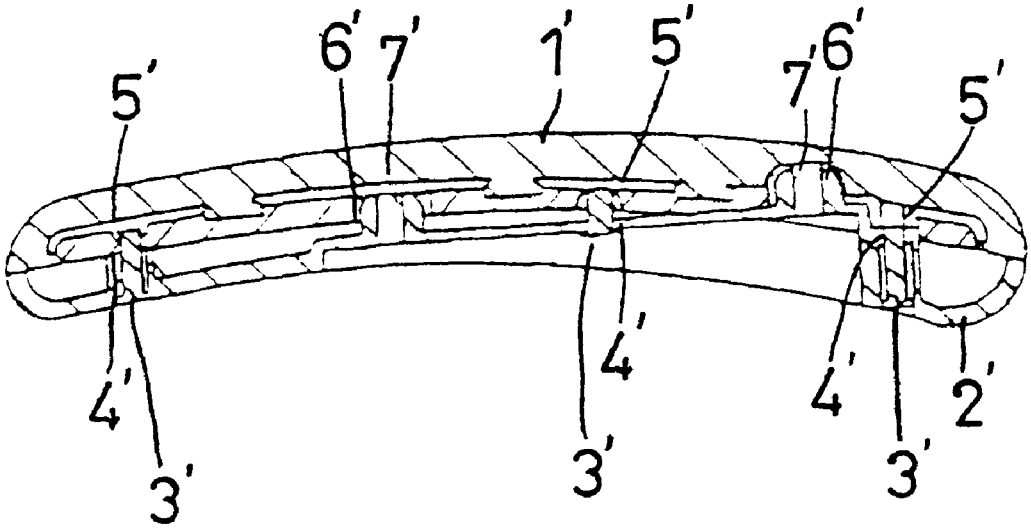
Fig. 6 PRIOR ART
FIG. 6 is a sectional view of a conventional armrest.
Figure 7:
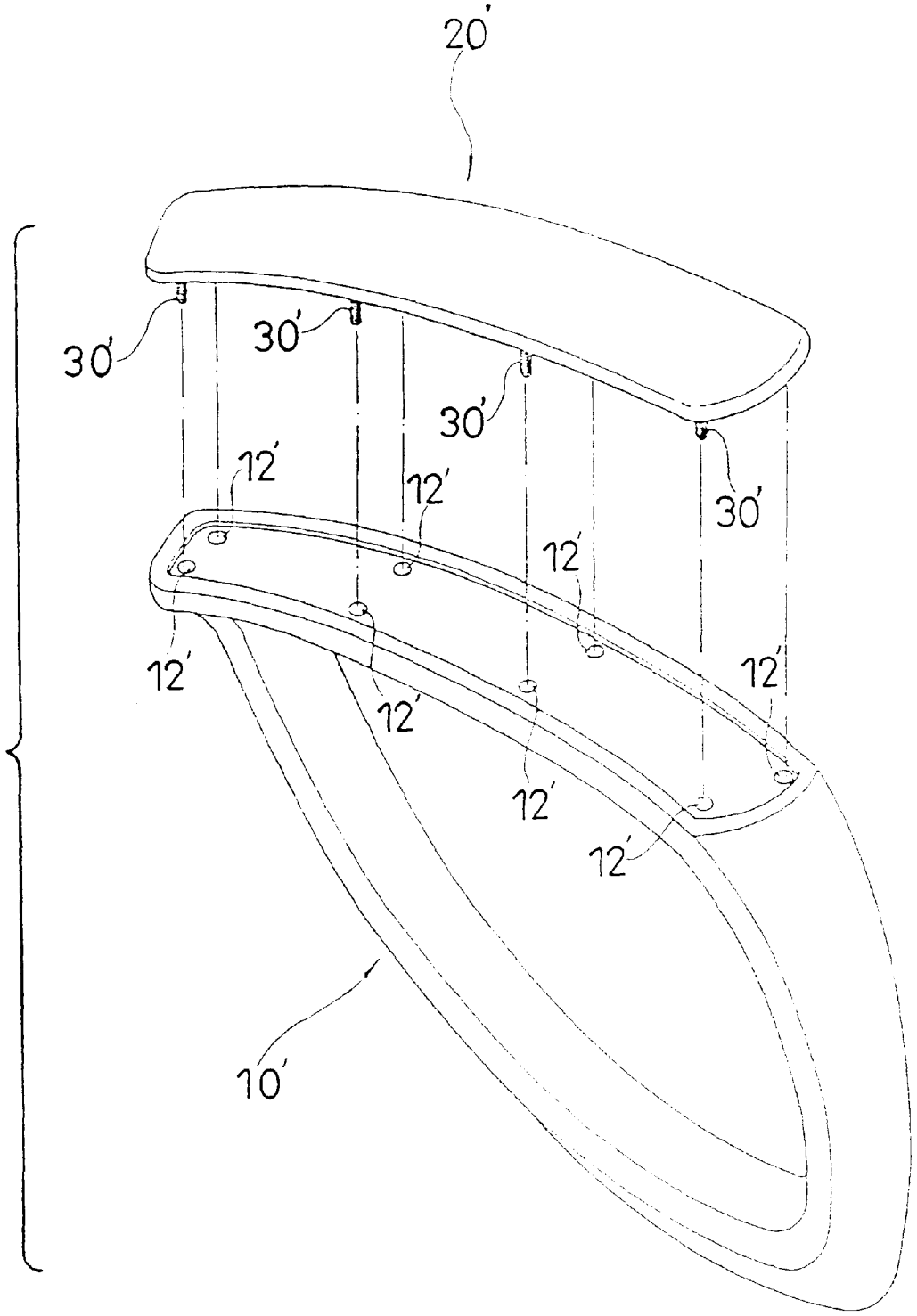
Fig. 7 PRIOR ART
FIG. 7 is an exploded perspective view of another conventional armrest.

As illustrated in FIGS. 4 and 5, since the retainer ring sections 265, 266 of each retainer ring 26, 27 retains the nut fastener 40 in place, and the positioning claws 44 and 46 are securely mounted in the compartments 2686 and 2687, removal and rotation of the nut fastener 40 is prevented, which is advantageous when using the screws 53 for engaging with armrest to the base 50. The assembly procedure can be easily and quickly accomplished. In addition, recycling of the armrest can also be achieved easily and quickly by means of damaging the retainer ring sections 265 and 266 and removing the metal nut fasteners 40 from the retainer rings 26, 27. Engagement between the upper fixing plates 11, 12, 13, 14, the lower fixing plates 21, 22, 23, 24, and the engaging means 30, 31, 32, 33 is clearly shown in FIG. 5.

It is noted that the armrest in accordance with the present invention is suitable for a chair with an adjustable armrest, yet adjustment of the armrest is beyond the scope of the invention and thus not described.

Although the invention has been explained in relation to its preferred embodiment, it is to be understood that many other possible modifications and variations can be made without departing from the spirit and scope of the invention as hereinafter claimed.

What is claimed is:

1. An armrest comprising:

a lower cover including a plurality of retainer rings;

an upper cover mounted on top of the lower cover;

a plurality of nut fasteners mounted in the retainer rings, respectively, each said nut fastener having a screw hole; and means for securely engaging the upper cover with the lower cover.

2. The armrest as claimed in claim 1, wherein the lower cover includes a plurality of lower fixing plates and the upper cover includes a plurality of upper fixing plates, and wherein the engaging means includes a plurality of engaging members for securely engaging the upper fixing plates with the lower fixing plates.

3. The armrest as claimed in claim 2, wherein each said engaging member is a substantially S-shape plate and includes a first outer plate section, a second outer plate section, and an intermediate plate section between the first outer plate section and the second outer plate section, wherein the first outer plate section and intermediate plate section together define a first compartment for securely holding an associated said upper fixing plate of the upper cover, and wherein the second outer plate section and the intermediate plate section together define a second compartment for securely holding an associated said lower fixing plate of the lower cover.

4. The armrest as claimed in claim 3, wherein each said upper fixing plate of the upper cover includes a vertical recess for receiving the first outer plate section of an associated said engaging member.

5. The armrest as claimed in claim 4, wherein the first outer plate section of each said engaging member includes two notches defined in two opposite sides thereof, the notches being engaged with two vertical side walls that define the vertical recess of the associated upper fixing plate.

6. The armrest as claimed in claim 3, wherein each said lower fixing plate of the lower cover includes a vertical recess for receiving the second outer plate section of an associated said engaging member.

7. The armrest as claimed in claim 6, wherein the second outer plate section of each said engaging member includes two notches defined in two opposite sides thereof, the notches being engaged with two vertical side walls that define the vertical recess of the associated lower fixing plate.

8. The armrest as claimed in claim 1, wherein each said retainer ring includes an inner ring therein, the inner ring including a through-hole, and wherein each said nut fastener includes an enlarged head and a stem that is mounted in the through-hole.

9. The armrest as claimed in claim 8, wherein each said retainer ring includes four vertical slits to thereby form two retainer ring sections in which each said retainer ring section is defined between two adjacent said slits, each said retainer ring including a projection with an inclined outer surface for guiding an associated said nut fastener into the associated retainer ring.

10. The armrest as claimed in claim 9, wherein each said inner ring further includes four stops projected outward from an outer periphery thereof, wherein a first and a second of the four stops together define a first compartment, and a third and a fourth of the stops together define a second compartment, and wherein each said nut fastener includes two claws extended outward from the enlarged head thereof, wherein a first of the two claws is engaged in the first compartment and a second of the two claws is engaged in the second compartment to thereby prevent rotation of the nut fastener in the retainer ring.

11. The armrest as claimed in claim 10, wherein the lower cover includes a plurality of lower fixing plates and the upper cover includes a plurality of upper fixing plates, and wherein the engaging means includes a plurality of engaging members for securely engaging the upper fixing plates with the lower fixing plates.

12. The armrest as claimed in claim 11, wherein each said engaging member is a substantially S-shape plate and includes a first outer plate section, a second outer plate section, and an intermediate plate section between the first outer plate section and the second outer plate section, wherein the first outer plate section and intermediate plate section together define a third compartment for securely holding an associated said upper fixing plate of the upper cover, and wherein the second outer plate section and the intermediate plate section together define a fourth compartment for securely holding an associated said lower fixing plate of the lower cover.

13. The armrest as claimed in claim 12, wherein each said upper fixing plate of the upper cover includes a vertical recess for receiving the first outer plate section of an associated said engaging member.

14. The armrest as claimed in claim 13, wherein the first outer plate section of each said engaging member includes two notches defined in two opposite sides thereof, the notches being engaged with two vertical side walls that define the vertical recess of the associated upper fixing plate.

15. The armrest as claimed in claim 12, wherein each said lower fixing plate of the lower cover includes a vertical recess for receiving the second outer plate section of an associated said engaging member.

16. The armrest as claimed in claim 15, wherein the second outer plate section of each said engaging member includes two notches defined in two opposite sides thereof, the notches being engaged with two vertical side walls that define the vertical recess of the associated lower fixing plate.

* * * * *